United States Patent [19]

Leach, Jr.

[11] 4,438,421

[45] Mar. 20, 1984

[54] MOUNTING BRACKET FOR A TRANSFORMER

[75] Inventor: Earl A. Leach, Jr., Masonville, N.Y.

[73] Assignee: The Bendix Corporation, Southfield, Mich.

[21] Appl. No.: 423,355

[22] Filed: Sep. 24, 1982

[51] Int. Cl.[3] ..... H01F 15/02

[52] U.S. Cl. ..... 336/65; 248/300; 336/67; 336/68; 336/98

[58] Field of Search ..... 248/300; 336/65, 67, 336/68, 98

[56] References Cited

U.S. PATENT DOCUMENTS

| | | | |
|---|---|---|---|
| 1,759,035 | 5/1930 | Bouche et al. . | |
| 2,246,167 | 6/1941 | D'Entremont | 175/358 |
| 2,425,155 | 8/1947 | Jarvis | 336/67 X |
| 2,699,531 | 1/1955 | Massar | 336/92 |
| 3,028,567 | 4/1962 | Mittermaier | 336/65 |
| 3,037,177 | 5/1962 | Marsh et al. | 336/210 |
| 3,244,941 | 4/1966 | Maynard et al. | 317/119 |
| 3,691,493 | 9/1972 | Boysen et al. | 336/65 |
| 3,750,072 | 7/1973 | Weiner | 336/65 X |

FOREIGN PATENT DOCUMENTS

| | | | |
|---|---|---|---|
| 56-81910 | 7/1981 | Japan | 336/65 |
| 429800 | 6/1935 | United Kingdom . | |

*Primary Examiner*—J. V. Truhe
*Assistant Examiner*—S. Steward
*Attorney, Agent, or Firm*—Raymond J. Eifler; Charles D. Lacina

[57] ABSTRACT

A vibration resistant mounting bracket (10) that secures a power transformer (20,30) within the housing of an aircraft ignition system. The bracket (10) has a single source (11) that extends through the winding (30) and partially around the core (20) of the transformer and is characterized by a pair of downwardly facing surface portions (44, 45) and a pair of upwardly facing surface portions (52,53) which are located in parallel planes with each pair of surfaces being axially offset from each other.

6 Claims, 6 Drawing Figures

MOUNTING BRACKET FOR A TRANSFORMER

This invention relates to an aircraft ignition system and more specifically to a mounting bracket for a power transformer within an ignition system housing.

Aircraft engines require an ignition system to supply an electrical spark to the engine. The ignition system is located in a housing within the aircraft. Since both weight and space are at a premium the ignition system is made as lightweight and compact as possible. The system is also made as rugged as possible because of the severe vibration it will be subjected to during flight. One of the largest and heaviest components in the ignition system is the power transformer which must be mounted within the ignition system housing. In certain ignition units the transformer is cemented into a corner of the housing using a resilient silicone cement. This is an inexpensive method, but due to the resilient nature of the adhesive, it does little to dampen vibration. Further, the cement may fail and allow the transformer to become unsecured and cause substantial damage or failure to the ignition system. Accordingly, it has been a problem in an aircraft ignition system to provide a secure mount of the power transformer while at the same time dampening the effect of vibration. Examples of mounting brackets for a transformer may be found in U.S. Pat. No. 2,246,167 issued June 17, 1941 and entitled "Transformer" and U.S. Pat. No. 3,037,177 issued May 29, 1962 and entitled "Stationary Induction Apparatus".

DISCLOSURE OF THE INVENTION

This invention is a vibration resistant mounting bracket that secures a power transformer within the housing of an aircraft ignition system. The bracket has a portion that extends through the winding and partially around the core of the transformer and is characterized by a pair of downwardly facing surface portions and a pair of upwardly facing surface portions each of which are located in respective parallel planes with each pair of surfaces being axially offset from the other and secured to the inside of the ignition system housing.

Accordingly, it is an advantage of this invention to provide a transformer mounting bracket that is resistent to and dampens vibration.

Another advantage of this bracket is that it supplies additional support for the transformer core while only requiring four bolts to fasten the bracket within the ignition system housing.

Another advantage of this invention is that the specific design of the mounting bracket assures a solid mount for the transformer while countering various vibration vectors.

DETAILED DESCRIPTION OF THE INVENTION

Figure 1:
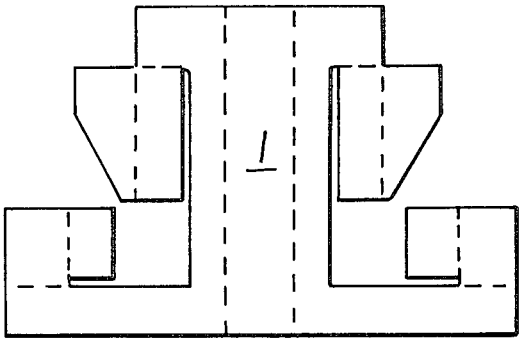
FIG. 1 illustrates a blank of metal used to form the bracket.

Referring now to the drawings, FIG. 1 illustrates a metal blank 1 having a thickness of about 0.032 inches (approximately 0.08 centimeters). The dotted lines indicates where the metal is to be folded to form the mounting bracket.

Figure 2:
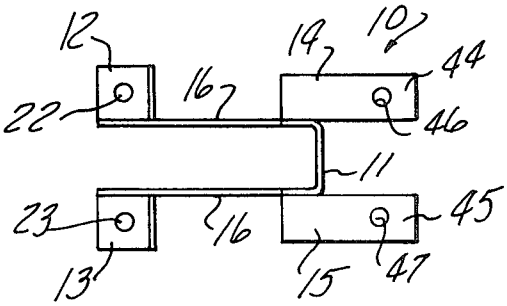

FIG. 2 illustrates a bottom view of the mounting bracket 10 which includes a U-shaped base portion 16 first and second forwardly extending forward members 14 and 15 and third and fourth outwardly extending rear members 12 and 13. The forward members 14 and 15 include downwardly facing surfaces 44, 45 each having an opening therein to receive a bolt for fastening the bracket to a portion of the inside of an ignition housing. Similarly the rear members 12, 13 include openings 22 and 23 for receiving bolts for fastening that portion of the mounting bracket to the inside of an ignition system housing. The vertical axes of the openings 46 and 47 of the forward members 14 and 15 are axially offset from the vertical axis of the openings 22 and 23 in the rear members 12 and 13. This arrangement helps to dampen any vibration that the bracket 10 is subjected to when the bracket is bolted to the inside of an ignition system housing.

Figure 3:
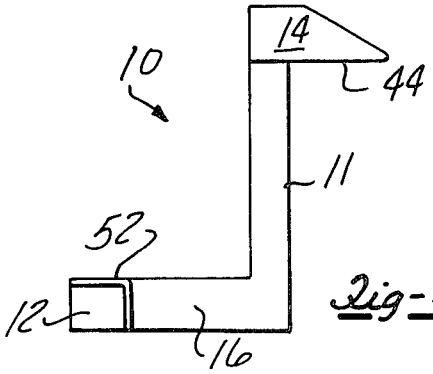
FIGS. 2, 3 and 4 illustrate bottom, side and back views of a transformer mounting bracket incorporating the principles of this invention.

FIG. 3 is a side view of the mounting bracket 10 and illustrates the vertical channel 11 which extends upwardly from the forward portion of the base 16 of the bracket. The forward member 14 extending forwardly from the outer surface of the upper portion of the vertical channel 11 includes a downwardly facing surface 44. The rear member 12 extending outwardly from a respective outer surface of the rear portion of the channel 16 includes an upwardly facing surface 52.

Figure 4:
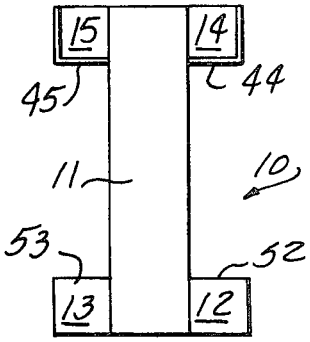

FIG. 4 is a rear view of the bracket 10 which illustrates the upwardly facing surfaces 52 and 53 of the rear members 12, 13 and the downwardly facing surfaces 44 and 45 of the forward members 14, 15. Each of these surfaces will abut against a portion of the inside of the ignition system housing so that the bracket may be securely mounted within the housing.

Figure 5:
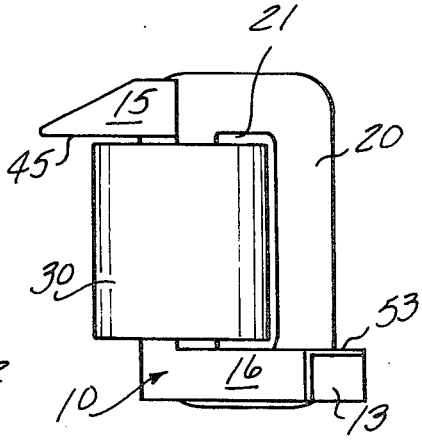
FIGS. 5 and 6 illustrate the bracket and transformer assembly.

FIG. 5 illustrates a side view of the transformer bracket 10, the transformer winding 30, and the transformer core 20. The transformer core 20 includes an opening 21 so that the winding 30 may be wound around a portion of the core 20 and the bracket 10.

Figure 6:
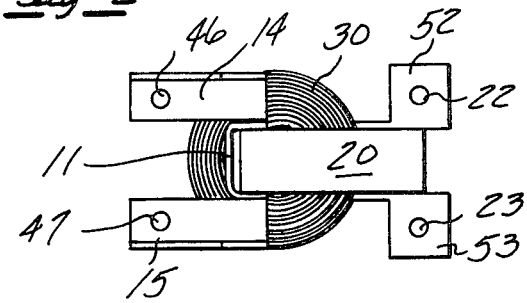

FIG. 6 illustrates how a portion of the transformer core 20 is located between the sides of the vertical channel 11. This arrangement helps to save space as well as providing additional support to the transformer core.

While a preferred embodiment of the invention has been disclosed, it will be apparent to those skilled in the art that changes may be made to the invention as set forth in the appended claims and, in some instances, certain features of the invention may be used to advantage without corresponding use of other features. For instance, instead of mounting the bracket to the ignition housing with nuts and bolts it could be mounted by welding the downwardly facing surfaces 44 and 45 and the upwardly facing surfaces 52 and 53 to surfaces within the ignition system housing. Accordingly, it is intended that the illustrative and descriptive materials herein be used to limit the principles of the invention and not to limit the scope thereof.

Having described the invention, what is claimed is:

1. A mounting bracket for a transformer of the type having a core structure having a center opening and a winding wound around a portion of said core, the improvement wherein said bracket comprises:

a U-shaped base portion having a foreward end and a rearward end;

a vertical channel extending upwardly from the forward end of said U-shaped base portion;

first and second members extending forwardly from a respective outer side of the upper portion of said vertical channel, said first and second members including respective downwardly facing surface portions disposed in the same plane; and third and fourth members extending outwardly from a respective outer side of the rear portion of said U-shaped base portion, said third and fourth members including respective upwardly facing surface portions, located in a plane parallel to the plane in which the first and second members are located.

2. The mounting bracket as described in claim 1 wherein said bracket is formed from a single piece of metal.

3. The mounting bracket as described in claim 1 wherein the vertical axis of the upwardly facing surface portions of said third and fourth members are offset from the vertical axis of said downwardly facing surface portions of said first and second members.

4. The mounting bracket as described in claim 2 wherein the vertical axis of the upwardly facing surface portions of said third and fourth members are offset from the vertical axis of said downwardly facing surface portions of said first and second members.

5. The mounting bracket as described in claims 1, 2, 3 or 4 wherein the vertical portion of said bracket extends through said winding.

6. The mounting bracket is described in claims 1, 2, 3 or 4 wherein a portion of said core is located in a portion of said vertical channel and wherein the same portion of said vertical channel extends through said winding.

* * * * *